United States Patent [19]

Hodge et al.

[11] 4,169,448

[45] Oct. 2, 1979

[54] AIR HEATER SYSTEM

[75] Inventors: Peter C. Hodge; William S. May, both of High Wycombe, England

[73] Assignee: Lucas Industries Limited, Birmingham, England

[21] Appl. No.: 924,671

[22] Filed: Jul. 14, 1978

Related U.S. Application Data

[63] Continuation-in-part of Ser. No. 713,912, Aug. 12, 1976, abandoned.

[30] Foreign Application Priority Data

Jun. 22, 1976 [GB] United Kingdom ..... 25823/76

[51] Int. Cl.[2] ..... F02M 31/00; F04B 3/00

[52] U.S. Cl. ..... 123/179 H; 123/122 G; 417/252

[58] Field of Search ..... 123/179 H, 122 G, 142.5 R; 417/252

[56] References Cited

U.S. PATENT DOCUMENTS

| | | | |
|---|---|---|---|
| 1,825,661 | 10/1931 | Gull | 417/252 |
| 2,837,102 | 6/1958 | Bauer et al. | 417/252 |
| 2,993,487 | 7/1961 | Konrad et al. | 123/179 H |
| 3,626,917 | 12/1971 | Tronel | 123/179 H |
| 3,687,122 | 8/1972 | Kane | 123/179 H |
| 3,912,419 | 10/1975 | Lutz | 417/252 |
| 3,996,912 | 12/1976 | Dreisen et al. | 123/179 H |

*Primary Examiner*—Charles J. Myhre
*Assistant Examiner*—David D. Reynolds

[57] ABSTRACT

An air heating system for a compression ignition engine comprises a combustion chamber which includes a burner through which fuel is supplied to the combustion chamber. A two stage fuel pump is provided to supply fuel to the burner with the output of the second stage being connected to the burner and the input of the second stage being connected to the output of the first stage. Valve means is provided to ensure that there is substantially no pressure drop across the second stage of the pump and control means is provided to control the speed of operation of the pump so that the rate of fuel delivery to the combustion chamber can be closely controlled.

18 Claims, 5 Drawing Figures

AIR HEATER SYSTEM

This Application is a continuation-in-part application of our application Ser. No. 713,912, Filed 8-12-76, now abandoned and relates to an air heater system for a compression ignition engine.

In order to facilitate the starting of a compression ignition engine it is necessary to supply heat to the engine and the most convenient way of doing this is to burn fuel in a combustion chamber which is disposed in, or forms part of an air inlet to the engine. The supply of fuel to the combustion chamber must be carefully controlled in order that the correct amount of heat is supplied. Moreover, in the case of a super-charged compression ignition engine it is often necessary to maintain the supply of heat during running of the engine to ensure that proper combustion of fuel injected into the combustion space or spaces of the engine, takes place. Whilst the engine is running the amount of heat supplied must also be carefully controlled. One problem in controlling the supply of fuel to the combustion chamber is the fluctuation in the pressure of fuel supplied by a source. For example where the source of fuel is an electric pump which is powered by an accumulator, variations in the voltage of the accumulator can effect the pressure of fuel supplied by the pump. Such voltage variation can occur where for example, the accumulator is used to power the cranking system of the engine.

The object of the present invention is to provide an air heater system for a compression ignition engine in a simple and convenient form.

According to the invention an air heater system for a compression ignition engine comprises a combustion chamber including a burner through which fuel is supplied to the combustion chamber, a two stage fuel pump for supplying fuel to the burner, each stage of the fuel pump being of the fixed displacement type and having an inlet and an outlet, passage means through which the outlet of the second stage is connected to the burner and further passage means through which the input of the second stage is connected to the outlet of the first stage the input of which is, in use, connected to a source of fuel, the rate of fuel delivery of said pump being dependent upon the speed at which the pump is driven, first motor means for driving said pump, valve means including a valve element responsive to the inlet and outlet pressures of the second stage of the pump for controlling the size of a spill port connected to said further passage means, said valve means being operable in use to spill fuel through said spill port so that there is substantially no pressure drop across the second stage of the pump said first stage of the pump being arranged to pump more fuel than the second stage and control means for controlling the speed of operation of the pump.

An example of an air heating system in accordance with the invention will now be described with reference to the accompanying drawings in which.

Figure 1:
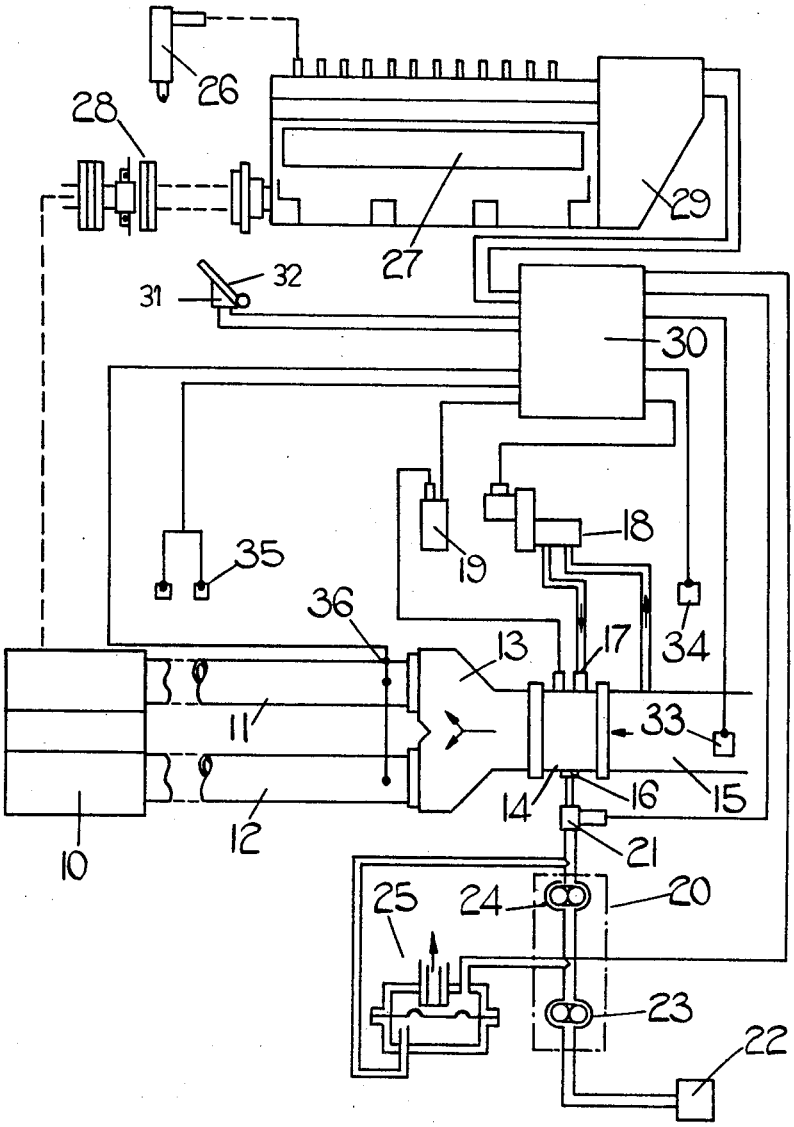
FIG. 1 is a diagrammatic layout of the system as applied to a compression ignition engine.

Referring to FIG. 1 of the drawings, there is shown a compression ignition engine 10 of Vee type and having air inlet manifolds 11, 12. The inlet ends of the air inlet manifolds communicate by way of a junction member 13, with the outlet of a combustion chamber 14 and the inlet end of the combustion chamber 14 communicates by way of a pipe 15 with the outlet of the compressor section of a turbo-supercharger (not shown). The turbine of the turbo-supercharger is driven by exhaust gases produced when the engine is in operation. Conveniently, the combustion chamber 14 is of a type similar to that which is described in U.S. Pat. No. 4,044,740.

The combustion chamber 14 incorporates a burner assembly to which liquid fuel is supplied by way of an inlet 16 and air under pressure by way of an inlet 17. The air under pressure is provided by means of an air pump generally indicated at 18 and which draws air from the pipe 15 at a position upstream of the combustion chamber.

The combustion chamber 14 also accommodates an ignition device such for example as a spark plug and electrical energy is supplied to the ignition device by means of a unit 19.

The inlet 16 is connected to the outlet of a fuel pump generally indicated at 20 but incorporated between the outlet of the pump and the inlet is an electrically operated valve 21. The purpose of this valve is to ensure that when the fuel pump 20 is not in operation, the pressure of air within the combustion chamber 14 due to operation of the supercharger, will not force fuel back through the pump. The inlet of the fuel pump is connected to a source of fuel under pressure and this, for example, is shown as a pump 22 conveniently accommodated in a fuel tank of the vehicle with which the engine is associated. The pump 22 is electrically driven and is powered from the vehicle accumulator or accumulators.

As will be seen from FIG. 1, the pump 20 is a two-stage pump the first stage being indicated at 23 and the second stage at 24. The two stages are positive displacement pumps which are driven by means of an electric motor (not shown). The displacement of the first stage is conveniently twice that of the second stage. Moreover, a valve generally indicated at 25 is provided to ensure that substantially no pressure drop occurs between the inlet and outlet of the second stage 24 of the pump 20. The outlet of the pump 20 is therefore proportional to the speed at which it is driven and the delivery of fuel to the combustion chamber can be readily controlled by altering the speed of the drive motor. The construction of the pump 20 and the valve 25 will be described in greater detail in due course. At this stage however it can be said that widely varying flow rates of fuel to the combustion chamber are required and in one example, a variation of between 0.3–4.0 gallons of fuel per hour are required. This is readily achieved by varying the speed of the motor and it has been found that even when the motor is operating at a relatively low speed to provide the low flow rate of fuel to the burner, there is substantially no variation in the actual flow rate even though appreciable variation in the output pressure of the pump 22 occurs.

In the particular example, the engine 10 has twelve cylinders and fuel is supplied to the combustion spaces of the engine by way of fuel injection nozzles, one of which is indicated at 26, it being appreciated that there are twelve such nozzles. Fuel is supplied to the nozzles at the appropriate time, by means of a pumping apparatus 27 which includes a cam shaft on which are mounted twelve cams for actuating individual injection pumps associated with the nozzles 26 respectively. The cam shaft of the pumping apparatus 27 is driven through a coupling 28 from the engine 10. The quantity of fuel which is supplied to the engine by the apparatus is varied in known manner, by means of an adjustable control rod the setting of which is determined in the particular example, by means of an electromagnetic actuator which is located within a housing 29 secured to the body of the apparatus 27. Also provided within the aforesaid housing is a transducer which can provide an electrical signal indicative of the actual position of the aforesaid control rod.

The supply of current to the electromagnetic actuator which determines the setting of the control rod is under the control of a control circuit generally indicated at 30. The control circuit receives a demand signal from a transducer 31 associated with the throttle pedal 32 and in addition it receives various signals indicative of engine operating conditions. One such signal is provided by a transducer 33 providing an indication of the pressure of air which is being supplied to the engine. A further such signal is provided by a temperature sensor 34 which provides an indication of the temperature of a metallic part of the engine structure. Further sensors 35 are provided which indicate the temperature of the exhaust of the engine. Also located within the housing 29 is a transducer which provides a signal indicative of the speed of the apparatus and therefore of the engine. The signals provided by the various components are processed in the control circuit 30 part of which will be described with reference to FIG. 5 and the remainder of which is described in U.S. Pat. No. 3,911,883. A signal is provided to the electromagnetic actuator which sets the control rod so as to provide a fuel level which, so far as possible, enables the engine to meet the demand placed upon it by the operator of the vehicle. If the demand is such that for example, overspeeding of the engine would occur, then the control circuit limits the amount of fuel supplied to maintain the engine speed at a safe value. The signals provided by the sensors 34 and 35 are also utilised to effect a control of the fuel supplied to the engine under certain circumstances.

The compression ratio of the engine 10 since it is a supercharged engine, is lower than would be the case if the engine were un-supercharged. It is therefore necessary when starting the engine, to heat the air which is supplied to the engine remembering that the supercharger will not be effective to provide air under pressure at the cranking speed or even whilst the engine is running under light load conditions. The combustion chamber 14 when it is supplied with fuel and air, heats the air flowing to the engine to promote rapid starting of the engine and also during light load running of the engine, to improve the combustion of the fuel which is supplied to the engine by the pumping apparatus 27.

Figure 2:
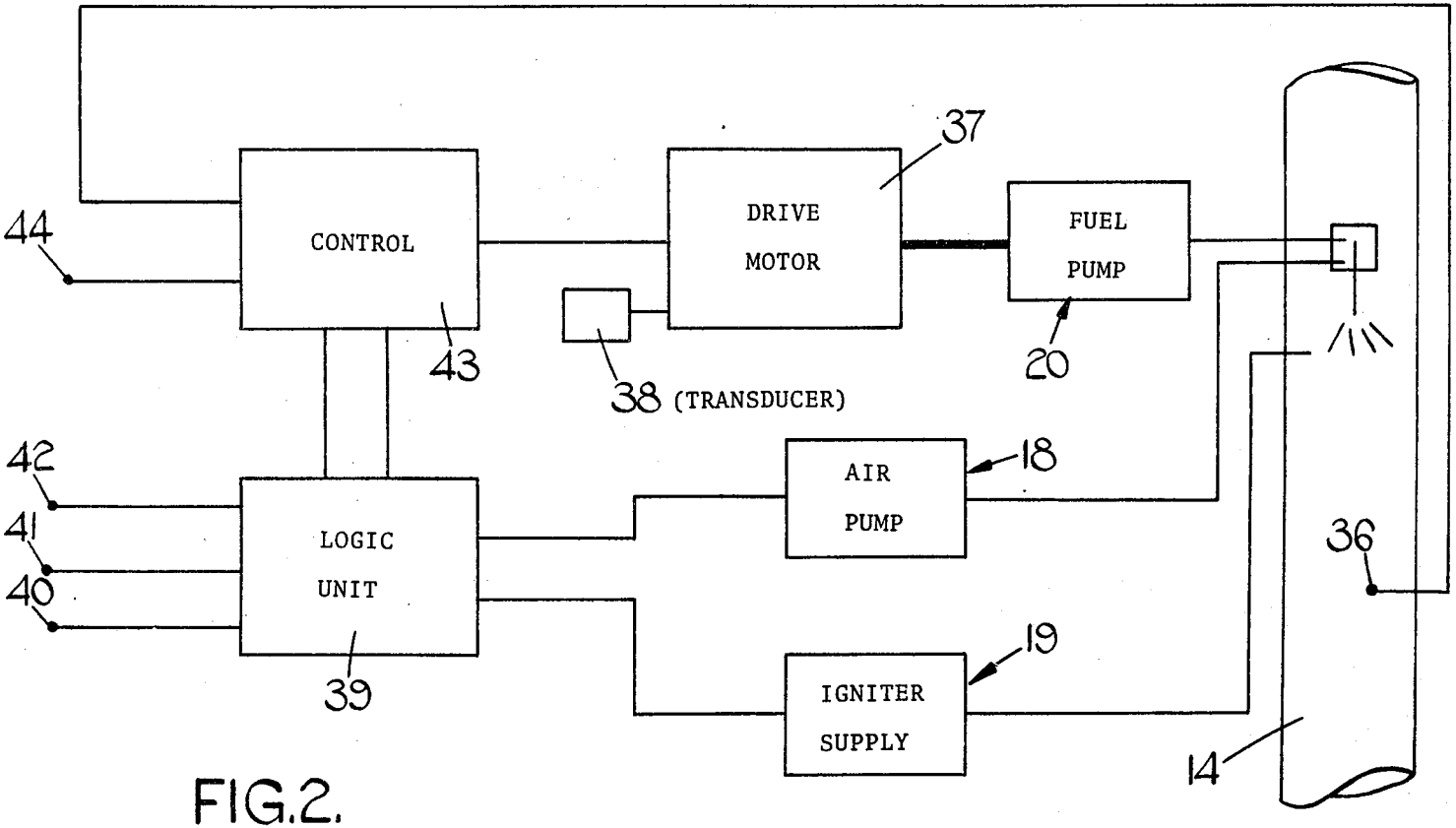
FIG. 2 is a block diagram of a portion of the system of FIG. 1.

Reference will now be made to FIG. 2 of the drawings which shows in block form the various components associated with the combustion chamber 14 and including electronic components for controlling the generation of heat by the combustion chamber. It will be noted that downstream of the combustion chamber and in practice, in the inlets of the air inlet manifolds 11, 12 there is mounted a temperature sensor 36. This sensor senses the temperature of the air supplied to the manifolds which varies in accordance with the amount of fuel which is supplied to the combustion chamber. Also shown in FIG. 2 is the drive motor 37 for the fuel pump 20 together with a transducer 38 which provides a signal indicative of the speed of rotation of the motor 37.

During the starting phase of the engine, it is required to supply fuel to the combustion chamber at a constant rate. In this manner the temperature of the air flowing through the inlet manifolds of the engine depends upon the cranking speed of the engine. Once the engine has reached its idling speed, then the control of fuel to the combustion chamber when the engine is running on light load, is arranged in accordance with the temperature of the air sensed by the sensor 36. During this phase therefore there is closed loop control of the temperature. It will be appreciated that the supply of fuel to the combustion chamber must be prevented if for some reason the engine should stop or be stopped and it is also required to prevent fuel supply to the combustion chamber in the event that the engine speed exceeds a predetermined value. Moreover, once the pressure of air delivered by the supercharger has attained a predetermined value, the combustion of fuel by the engine will proceed in a satisfactory manner without the need to pre-heat the air supplied to the engine. The control system for the various components includes a logic unit 39 which receives a first input at terminal 40 indicative of the pressure of air delivered by the supercharger and conveniently derived from the transducer 33. The logic unit also receives at an input 41, a signal indicative of the fact that the engine speed is below a predetermined value and a further signal at an input 42 indicative of the actual engine speed. The speed of the motor 37 is determined by a control 43 which receives an input signal from the temperature sensor 36 and also at an input 44, a reference signal appropriate to the temperature of air required to be supplied to the engine when the engine has started. As has been said however, during the starting of the engine fuel is supplied to the combustion chamber at a constant rate and the supply of fuel and also air is initiated when during cranking, the engine speed exceeds a predetermined low value for example 60 r.p.m. When the engine speed attains this value the air pump 18 the igniter supply 19 and the motor 37 are energised and a flame is established in the combustion chamber. If for some reason, a flame is not established within a predetermined time, the flame being detected by means of the sensor 36, then the system is turned off and cannot be restarted until the engine speed is allowed to fall below the aforementioned predetermined low value. When the engine starts and its speed attains a second value in the particular example, 400 r.p.m. the unit 19 is de-energised and the logic unit switches the control 43 so that a closed loop control of the fuel is obtained. The reference applied at the terminal 44 sets the value of the air temperature of air flowing in the manifolds and the control adjusts the speed of the motor so as to achieve this temperature. The supply of fuel continues and is controlled either until the engine speed exceeds a predetermined value or the pressure of air supplied by the supercharger exceeds a predetermined value. When either of these values is attained, the system is shut off and the engine is allowed to operate without the supply of fuel to the combustion chamber. If after a period of use under load, the engine is allowed to run on no load then when both the engine speed and the pressure of air supplied to the engine fall below the aforesaid values, the supply of fuel of the combustion chamber will be re-established. Conveniently the unit 19 supplies energy to the sparking plug whenever the temperature of the air flowing in the manifold is below a predetermined value. In this manner ignition of the fuel supplied to the combustion chamber will be quickly established. The supply of energy by the unit 19 is however prevented when the temperature sensed by the sensor 36 indicates that a flame is established and when the engine is operating within a predetermined engine speed band above idling speed.

Figure 5:
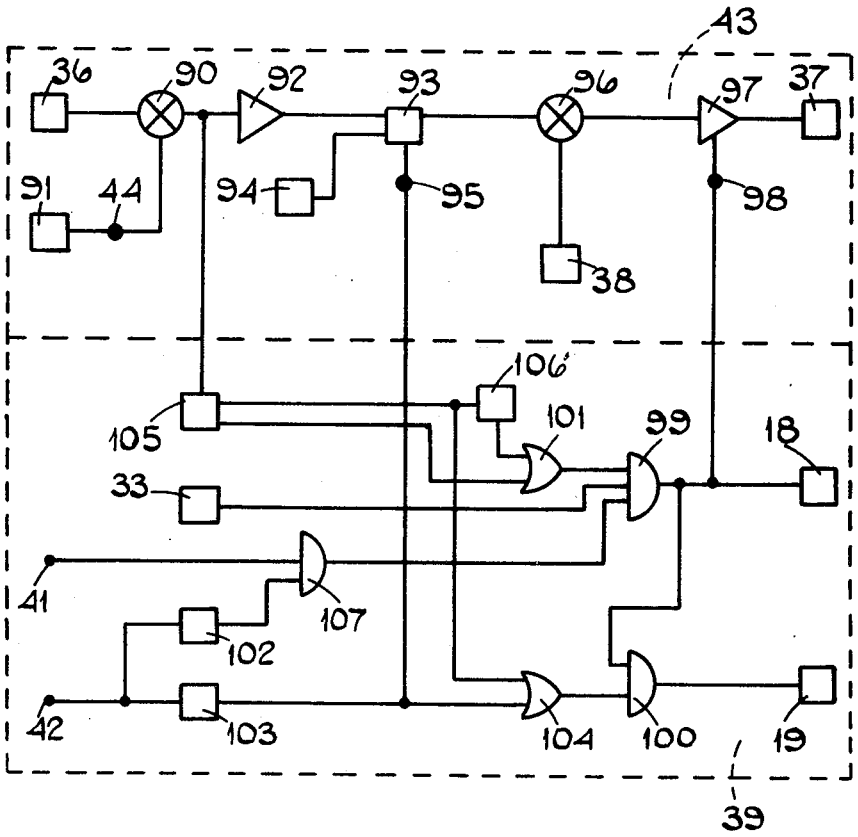
FIG. 5 is a diagram of two portions of the block diagrams seen in FIG. 2.

With reference to FIG. 5 of the drawings the control 43 and the logic unit 39 are illustrated together. The output of the air temperature sensor 36 is connected to one input of a differential amplifier 90 the other input of which is connected to terminal 44 this in turn being connected to a reference source 91. The output of the amplifier 90 is connected to the input of an amplifier 92 the output of which is connected to one input terminal of a changeover switch 93. The other input of the changeover switch is connected to a reference source 94 and the changeover switch has a control input 95. The output of the switch 93 is connected to one input terminal of a further differential amplifier 96 the other input of which is connected to the transducer 38 which provides a signal indicative of the speed of the motor 37. The output of the amplifier 96 is connected to the input of a power amplifier 97 the output of which is fed to the motor 37. Moreover, the power amplifier has a control input 98.

The logic unit 39 includes a first AND-gate 99 having three inputs and an output. The output of the AND-gate 99 is connected to the control input 98 of the amplifier 97, to the air pump 18 and to one input of a further AND-gate 100. The output of the AND-gate 100 is connected to the ignitor 19.

One input of the AND-gate 99 is connected to the output of and OR-gate 101, the second input of the AND-gate 99 is connected to the pressure sensor 33 and the third input of the AND-gate 99 is connected to the output of an AND-gate 107.

One input of the AND-gate 107 is connected to terminal 41 and the other input of AND-gate 107 is connected to the output of a level detector 102 the input of which is connected to the terminal 42. The terminal 42 is also connected to the input of a further level detector 103 the output of which is connected to the controlled input 95 of the switch 93 and to one input of a further OR-gate 104. The output of the OR-gate 104 is connected to the second input of the AND-gate 100 and the other input terminal of the OR-gate 104 is connected to one output of a level detector 105 which receives its input from the output of the differential amplifier 90. Said output of the level detector 105 is connected to the input of a timer 106 the output of which is connected to one input of the OR-gate 101. The other input of the OR-gate 101 is connected to a second output of the level detector 105.

When the engine is at rest with the control 43 and the logic unit supplied with power, the AND-gate 99 will produce no output because there will be no signal applied to the terminal 41 and therefore no output from the AND-gate 107. There will however, be an input to the AND-gate 99 from the pressure tranducer 33 but not output from the OR-gate 101 because the timer 106 will not be operative and the level detector 105 will indicate that the temperature is below the desired value. When the engine is cranked however and when it attains the first predetermined speed, the timer 106 will start to operate and in addition an output will appear at the output of the AND-gate 107. The AND-gate 99 will therefore receive the three inputs it requires to produce an output and this being the case the amplifier 97 drives the motor 37 and the air pump motor 18 is started. Moreover, the AND-gate 100 receives its second input and the ignitor 19 will be operated. The switch 93 will be set to connect the output from the reference source 94 to the one input of the differential amplifier 96. Providing the temperature as indicated by the sensor 36 increases so that the output of the differential amplifier 90 decreases before the timer 106 ceases to operate, the level detector 105 will supply a signal to the second input of the OR-gate 101 and this system will continue to function. When the engine speed attains 400 r.p.m. the output from the level detector 103 disappears and the switch 93 changes over to provide a closed loop control of the temperature of the air flowing to the manifold. In addition the output is removed from the gate 104 and therefore the AND-gate 100 ceases to provide an output so that the ignitor 19 ceases to function. It should be noted however, that whenever there is an error at the output of the amplifier 90, a signal will be provided to the gate 104 which will provide one input to the AND-gate 100.

The system will cease to operate when the pressure of air as indicated by the sensor 33 rises above a predetermined value. When this occurs one input is removed from the AND-gate 99 and the system is de-energised. The system is also de-energised when the engine speed attains a further value for example 1500 r.p.m. This is indicated by the level detector 102 which ceases to provide a signal to the AND-gate 107 and as a result one of the inputs to the AND-gate 99 is removed so that again the system is de-energised.

The AND-gate 100 may be deleted and the output of the OR-gate 104 utilised to control the ignitor. In this case whenever there is a signal supplied to the OR-gate 104, the ignitor will be in operation.

It will be appreciated that the combustion chamber 14 has similar properties to the combustion chamber of a gas turbine engine, and therefore the regulation of the supply of fuel to the combustion chamber must be carefully controlled to avoid the flame being extinguished either because too much fuel is being supplied, or because too little fuel is being supplied. It is clear, however, that with increasing engine speed more fuel must be supplied to the combustion chamber in order to maintain the desired temperature of air supplied to the engine. It will be understood that whenever it is required that fuel should be supplied to the combustion chamber the valve 21 shown in FIG. 1 must be opened. The valve however is closed as soon as fuel is no longer required to prevent air forcing the fuel back through the fuel pump and thereby preventing rapid establishment of the flame in the combustion chamber when it is next required.

Figure 3:
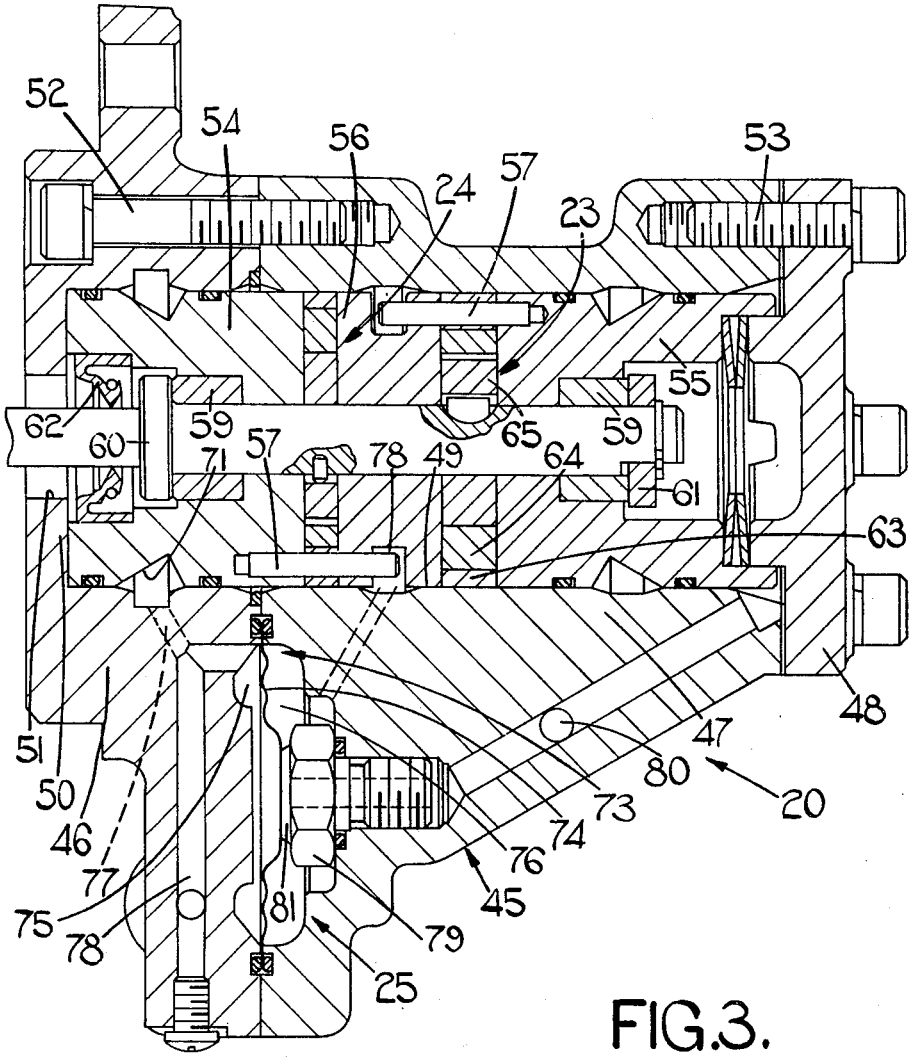
FIG. 3 is a sectional side elevation of a practical construction of a pump shown in FIG. 1.
Figure 4:
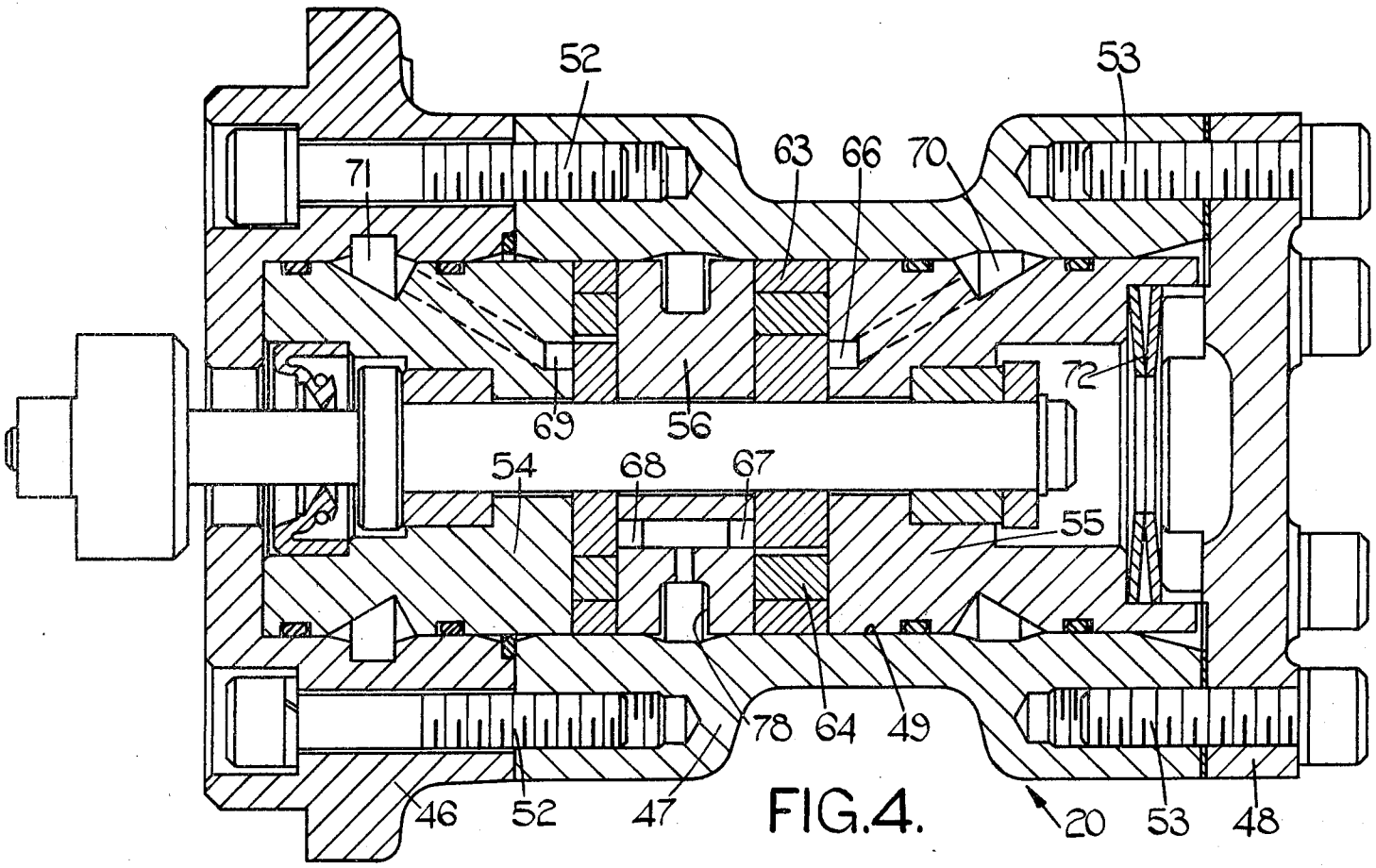
FIG. 4 is a view taken at right angles to FIG. 3.

Reference will now be made to FIGS. 3 and 4 of the drawings which show a practical construction of the pump unit 20. Referring to FIGS. 3 and 4 the pump unit has a housing 45 which is formed in three parts 46, 47 and 48. The parts 46 and 47 define a cylindrical bore 49 and the part 48 forms an end closure for this bore. The other end of the bore is partly closed by an end wall 50 deflined by the part 46 and in this end wall is formed an aperture 51. The joint between the housing parts 46 and 47 extends transversely of the axis of the bore and in addition, the parts 46 and 47 have a lateral extension which accommodates the valve 25.

Located within the bore 49 is a pump assembly which can be inserted into the bore after the parts 46 and 47 of the housing have been secured together by means of bolts 52. When the pump assembly is located within the bore the part 48 of the housing is secured by bolts 53 to the part 47 of the housing and the assembly of the pump is then complete.

Considering now the pump assembly this comprises a pair of outer stator portions 54, 55 and an intermediate stator portion 56. The stator portions are located angularly relative to each other by means of dowel pins 57.

The stator portions are provided with centrally disposed apertures through which extends a drive shaft 58 and this is journalled in annular carbon bearings 59 carried by the stator portions 54, 55 respectively. The shaft 58 near its end adjacent the end wall 50 is provided with a flange 60 and at its other end there is mounted a thrust member 61 which is retained upon the shaft by means of a circlip. Moreover, the stator portion 54 mounts an oil seal 62 which engages with the shaft at a position intermediate the flange 60 and the end wall 50. The shaft extends through the aperture 51 and carries a coupling by which it is coupled to an electric drive motor.

Located between the stator portions 55 and 56, are the components of the first stage 23 of the pump and located between the stator portions 54 and 56 are the components of the second stage 24 of the pump. Each stage is a gyratory pump. The two stages are of identical construction with the exception that the first stage 23 is dimensioned so that it pumps substantially twice the amount of fuel capable of being pumped by the second stage 24. A brief description of the construction of the stages will now be made with reference to stage 23 only.

The stage comprises an outer annular member 63 which has an aperture therein through which passes the dowel pin 57. The member 63 is thus constrained against angular movement. The cylindrical aperture defined in the member 63 is eccentrically disposed relative to the axis of rotation of the shaft 58. Located within the aperture is an inner annular member 64 having an outer cylindrical surface and an inner surface in which are formed gear teeth. Finally, the stage includes a gear 65 which is mounted about the shaft 58 and keyed thereto so as to rotate with the shaft. As the shaft rotates the member 64 will also be rotated but during such rotation will partake of gyratory movement.

An arcuate fuel inlet groove 66 (FIG. 4) is provided in the stator portion 55 and an arcuate fuel outlet 67 is provided in the stator portion 56. The outlet 67 communicates with an inlet 68 for the stage 24 and this is provided with an outlet 69 formed in the stator portion 54. The outlet 67 and the inlet 68 are interconnected by a passage formed in the stator portion 56. As will be seen, the passage extends through the stator portion 56 substantially parallel to the axis of rotation of the shaft and to enable this to be done, the two stages are disposed at 180° relative to each other about the axis of the shaft. The inlet 66 communicates with a circumferential groove 70 formed in the periphery of the stator portion 55 whilst the outlet 69 communicates with a groove 71 formed in the stator portion 54. On each side of the grooves 70, 71 the respective portions are provided with grooves which accommodate seal rings and the arrangement is such that when the pump assembly has been assembled it can be pushed axially into the bore 49 to the position shown in the drawing, in which the end face of the stator portion 54 engages the end wall 50 of the portion 46 of the housing. The pump assembly is retained in position by means of a pair of Bellville washers 72 which are located within an internal recess formed in the stator portion 55. The Bellville washers 72 are engaged by a projection formed on the housing part 48. A small clearance is provided between the end of the stator portion 55 and the part 48 of the housing to permit differential expansion of the housing and the pump assembly which in the particular example are formed from dissimilar metals, the housing being formed from aluminum alloy whilst the pump assembly is generally formed from steel. It will be noted that various part of the bore are provided with tapers to minimise the possibility of damage to the seal members as the pump assembly is pushed into the bore 49.

Turning now to FIG. 3, the valve 25 includes a valve chamber 73 defined between the two housing portions 46 and 47. Extending across the chamber is a diaphragm 74 which divides the chamber into two parts 75, 76. The chamber part 75 communicates with the circumferential groove 71 by way of a passage 77 and the passage 77 extends by way of a passage 78 to an outlet (not shown) on the housing portion 46 but which in use, is connected by way of the valve 21 to the burner assembly. It will be noted that the bore 49 is formed with a groove in register with the groove 71, furthermore, the bore is tapered towards the groove and this is to minimise damage to the seals when the pump assembly is inserted into the bore. The protion of the chamber 76 is connected to a further groove 78 formed in the peripheral surface of the stator portion 56. This groove communicates with the ports 67 and 68.

Also located in the chamber portion 76 is an outlet which is defined in a member 79 threaded into the housing portion 47. The outlet communicates with an outlet 80 which in use communicates with a drain. The outlet 80 also communicates with the space defined between the pump assembly and the portion 48 of the housing. The groove 70 formed on the pump assembly communicates with an inlet (not shown) and which in use is connected to the pump 22.

It will be seen that the diaphragm 74 is exposed on one side to the pressure intermediate the two stages of the pump and on the other side to the pressure at the outlet of the second stage. It has already been mentioned that the first stage of the pump is capable of pumping substantially twice the volume of fuel as compared with the second stage and therefore under most conditions of use, the diaphragm 74 will be displaced so as to permit surplus fuel to flow to the outlet 18. The effect of the diaphragm since it has a low rate, is to ensure that there is substantially no pressure drop across the second stage of the pump, so that the output of the pump is directly proportional to the speed at which the shaft 58 is rotated.

As will be seen from FIG. 3 the diaphragm at its periphery, is sandwiched between the two portions 46, 47 of the housing and annular sealing rings are disposed on the opposite sides of the diaphragm, the sealing rings being located within annular grooves. The diaphragm is formed from a berrylium copper alloy conveniently as a pressing and in the particular example a central disc 81 is provided which co-operates with the member 79 to control the flow of fuel through the outlet. The diaphragm may however be suitably shaped so that it is not necessary to provide the disc and it may be formed from other materials such, for instance as a synthetic rubber. Experience has shown that there is no real need to provide for adjustment of the axial position of the member 79. In some cases, however, this may be desirable and in such cases the member 79 is extended to the periphery of the housing and is provided with means for effecting angular adjustment which, by virtue of a screw thread, also effects axial adjustment.

We claim:

1. An air heater system for a compression ignition engine comprising in combination a combustion chamber including a burner through which fuel is supplied to the combustion chamber, a two stage fuel pump for supplying fuel to the burner, each stage of the pump being of the fixed displacement type and having an inlet and an outlet, passage means through which the outlet of the second stage is connected to the burner and further passage means through which the input of the second stage is connected to the outlet of the first stage the input of which is, in use, connected to a source of fuel, the rate of fuel delivery of said pump being dependent upon the speed at which the pump is driven, first motor means for driving said pump, valve means including a valve element responsive to the inlet and outlet pressures of the second stage of the pump for controlling the size of a spill port connected to said further passage means, said valve means being operable to use to spill fuel through said spill port so that there is substantially no pressure drop across the second stage of the pump, said first stage of the pump being arranged to pump more fuel than the second stage and control means for controlling the speed of operation of the pump.

2. A system according to claim 1, including an air pump for supplying air under pressure to the burner to assist atomization of the fuel and second motor means for driving the air pump.

3. A system according to claim 2, in which said control means is an engine starting mode maintains the speed of said first motor means substantially constant so that the rate of fuel supply to the burner is substantially constant.

4. A system according to claim 3, including temperature sensing means for sensing the temperature of air downstream of the combustion chamber to provide a signal to said control means to enable it to adjust the speed of said first motor means so that in an engine running mode, the temperature of air supplied to the engine is maintained substantially constant.

5. A system according to claim 4, including a logic unit responsive to at least one engine operating parameter for controlling the operation of said first and second motor means.

6. A system according to claim 5, including a speed transducer for providing a first signal to said logic unit indicative of the actual speed of the associated engine and a second signal indicative of when the engine speed is below a first value.

7. A system according to claim 6, in which said logic unit turns on said first and second motor means when the engine speed rises above said first value and turns said first and second motor means off when the engine speed rises above a second predetermined value.

8. A system according to claim 7, in which said logic unit between said first value of engine speed and a third value of engine speed intermediate said first and second values, causes said control means to operate in the engine starting mode.

9. A system according to claim 8, in which above said third value of engine speed said control means is operated in the engine running mode.

10. A system according to claim 9, including an igniter for igniting the fuel discharge by the burner and means for supplying electrical energy to said igniter.

11. A system according to claim 10, in which the logic unit controls the operation of said igniter, said igniter being rendered operative between said first and third values of speed but being turned off between said third and second values of speed whenever said temperature sensing means indicates that a flame is established in the combustion chamber.

12. A system according to claim 11, for a supercharged compression ignition engine, pressure sensing means being provided for sensing the pressure of air supply to an inlet manifold of the engine, the signal from said pressure sensing means being applied to said logic unit whereby said first and second motor means are turned off when the pressure of air in the inlet manifold exceeds a predetermined value.

13. A system according to claim 12, including an electromagnetic valve positioned between the pump and burner.

14. A system according to claim 13, in which said valve is controlled by said logic unit.

15. A system according to claim 11, including means for turning said first and second motor means off in the event that the flame is not established within a predetermined time.

16. A system according to claim 1, in which the valve element comprises a diaphragm which is exposed on opposite sides, to the inlet and outlet pressures of the second stage, the position of said diaphragm controlling the effective size of said spill outlet.

17. A system according to claim 16, in which said diaphragm mounts a disc co-operating with said spill outlet.

18. A system according to claim 16, in which said gear pumps are gyratory gear pumps.

* * * * *